US005855409A

United States Patent [19]

Tseng

[11] Patent Number: 5,855,409

[45] Date of Patent: Jan. 5, 1999

[54] FOLDABLE CHAIR FRAME

[75] Inventor: Chuen-Jong Tseng, Chiayi Hsien, Taiwan

[73] Assignee: Shin Yen Enterprise Co., Ltd., Taiwan

[21] Appl. No.: 86,129

[22] Filed: May 28, 1998

[51] Int. Cl.[6] ..... A47C 4/00

[52] U.S. Cl. ..... 297/35; 297/27; 297/46

[58] Field of Search ..... 297/35, 27, 28, 297/46, 16.1, 38, 21, 51

[56] References Cited

U.S. PATENT DOCUMENTS

| | | | |
|---|---|---|---|
| 2,638,970 | 5/1953 | Harber | 297/27 |
| 2,649,138 | 8/1953 | Rechler | 297/21 |
| 4,768,825 | 9/1988 | Quinlan | 297/35 |
| 4,792,181 | 12/1988 | Giochon | 297/28 |
| 4,898,421 | 2/1990 | Brunn | 297/35 |

*Primary Examiner*—Peter M. Cuomo
*Assistant Examiner*—Anthony D. Barfield
*Attorney, Agent, or Firm*—Ladas & Parry

[57] ABSTRACT

A foldable chair frame includes a backrest frame, a seat frame and an armrest member pivoted to the backrest frame, a front leg frame pivoted to the seat frame and the armrest member, and a rear leg frame disposed adjacent to the seat frame and pivoted to the armrest member. A rail member is mounted on the rear leg frame and is formed with an elongated guiding groove which opens toward the seat frame and which has an upper portion with a lateral locking section. A slide member projects transversely from the seat frame and extends rotatably into the guiding groove, and is movable slidably along the guiding groove to couple pivotally the seat frame and the rear leg frame. A releasable locking unit is mounted on the rail member at the upper portion of the guiding groove. The locking unit permits movement of the slide member into the locking section when unfolding the chair frame, and arrests movement of the slide member out of the locking section so as to position the chair frame in the unfolded state. The locking unit is operable to release the slide member from the locking section to permit downward sliding movement of the slide member along the guiding groove when folding the chair frame.

5 Claims, 6 Drawing Sheets

FOLDABLE CHAIR FRAME

BACKGROUND OF THE INVENTION

1. Field of the Invention

This invention relates to a foldable chair frame, more particularly to a foldable chair frame which is provided with a locking unit to prevent untimely folding of the chair frame.

2. Description of the Related Art

Foldable chairs are widely popular due to their reduced sizes after folding which facilitate transport and storage of the same. However, in recent years, user safety has been become an important consideration in the design of foldable chairs. As such, much attention is being paid to the provision of a foldable chair that can be positioned in an unfolded state and that can be prevented from untimely folding to ensure safety of the user seated thereon.

SUMMARY OF THE INVENTION

The main object of the present invention is to provide a foldable chair frame which can be positioned securely in an unfolded state.

Accordingly, the foldable chair frame of the present invention includes a backrest frame having a lower end, a seat frame having a rear end pivoted to the lower end of the backrest frame, an armrest member disposed adjacent to the backrest frame and having a rear end pivoted to the backrest frame, a front leg frame disposed adjacent to the seat frame and having an upper end pivoted to the armrest member, a lower end adapted to be supported on a ground surface, and an intermediate section between the upper and lower ends and pivoted to the seat frame, and a rear leg frame disposed adjacent to the seat frame and having an upper end pivoted to the armrest member, and a lower end adapted to be supported on a ground surface. The chair frame is movable between an unfolded state, in which the seat frame and the armrest member are substantially horizontal, the backrest frame and the front and rear leg frames are substantially upright, and the lower ends of the front and rear leg frames are spaced apart from one another, and a folded state, in which the backrest frame, the seat frame, the armrest member and the front and rear leg frames are substantially upright. A rail member is mounted on one side of the rear leg frame facing the seat frame between the upper and lower ends of the rear leg frame, and is formed with an elongated guiding groove which opens toward the seat frame and which extends along a longitudinal direction of the rear leg frame. The guiding groove has an upper portion with a lateral locking section that extends away from a longitudinal axis of the guiding groove. A slide member is mounted on the seat frame and projects transversely from the seat frame in a direction toward the rear leg frame. The slide member extends rotatably into the guiding groove and is movable slidably along the guiding groove to couple pivotally the seat frame and the rear leg frame. The slide member is disposed in the upper portion of the guiding groove when the chair frame is in the unfolded state, and is disposed in a lower portion of the guiding groove when the chair frame is in the folded state. A releasable locking unit is mounted on the rail member at the upper portion of the guiding groove. The locking unit permits movement of the slide member into the locking section when unfolding the chair frame, and arrests movement of the slide member out of the locking section so as to position the chair frame in the unfolded state. The locking unit is operable to release the slide member from the locking section to permit downward sliding movement of the slide member along the guiding groove when folding the chair frame.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
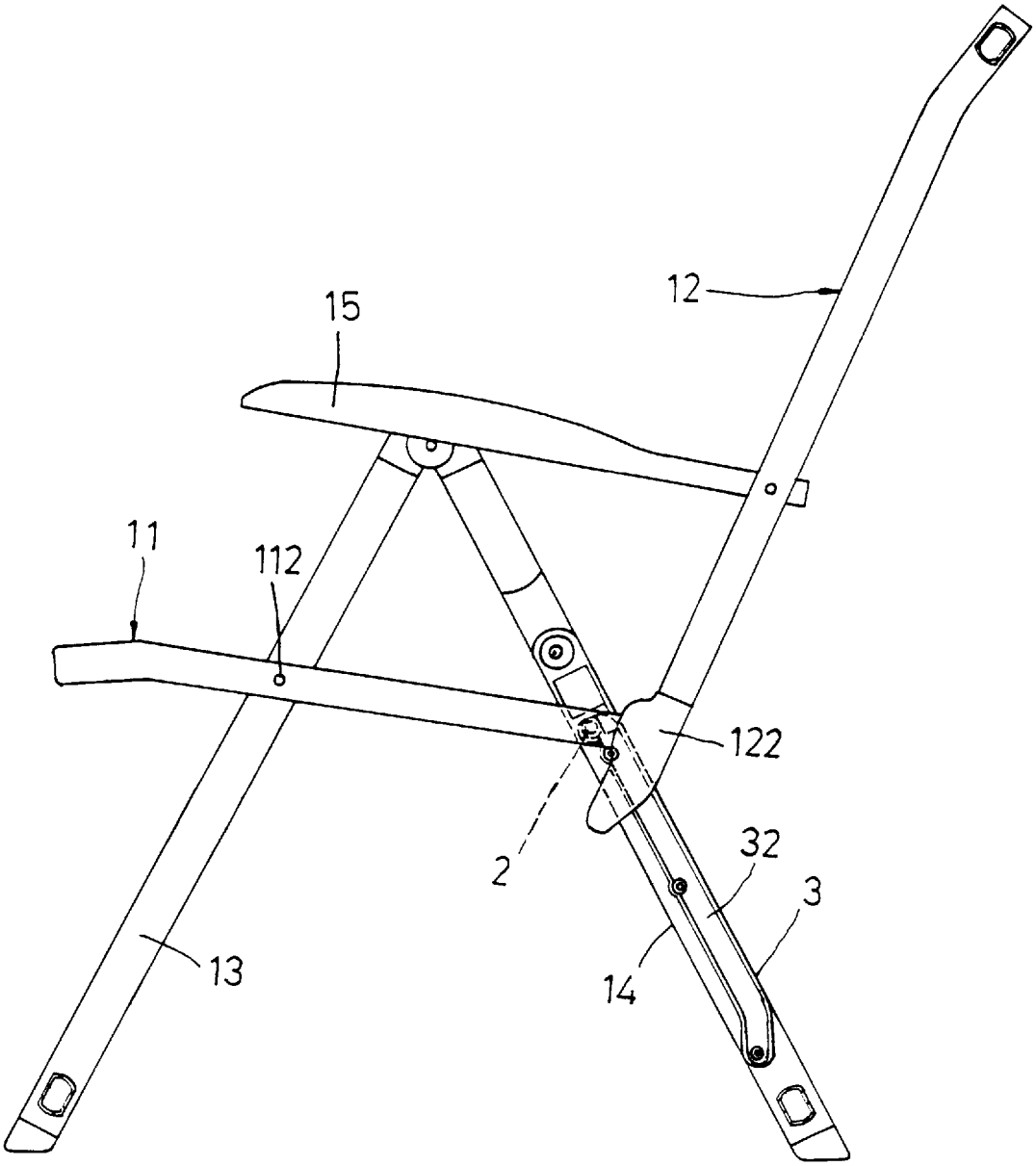
FIG. 1 is a schematic side view illustrating a prefer ed embodiment of a foldable chair frame according to the present invention when in an unfolded state.

Referring to FIG. 1, the foldable chair frame of the preferred embodiment according to the present invention generally includes a backrest frame 12, a seat frame 11, an armrest member 15, a front leg frame 13 and a rear leg frame 14.

The seat frame 11 has a rear end pivoted to a lower end of the backrest frame 12 by means of a pivot seat 122. The armrest member 15 is disposed adjacent to the backrest frame 12 and has a rear end pivoted to the backrest frame 12 at a middle section of the latter. The front leg frame 13 is disposed adjacent to the seat frame 11 and has an upper end pivoted to the armrest member 15, a lower end adapted to be supported on a ground surface, and an intermediate section between the upper and lower ends and pivoted to the seat frame 11 by means of a pivot pin 112. The rear leg frame 14 is disposed adjacent to the seat frame 11, and has an upper end pivoted to the armrest member 15 and a lower end adapted to be supported on a ground surface. The upper ends of the front and rear leg frames 13, 14 are disposed on a bottom side of the armrest member 15 and are movable forwardly and rearwardly along the armrest member 15.

Figure 6:
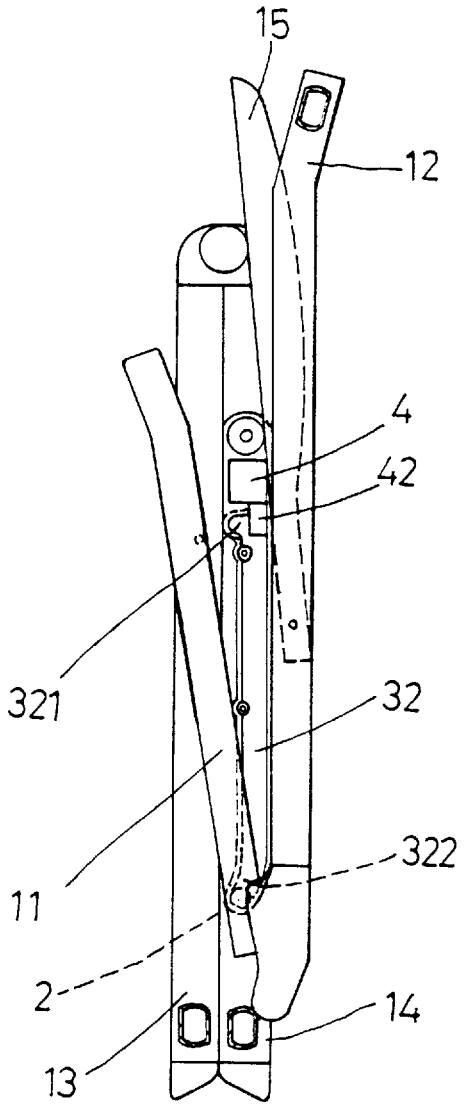
FIG. 6 is a side view illustrating the preferred embodiment when in a folded state.

When the chair frame is in an unfolded state, as shown in FIG. 1, the seat frame 11 and the armrest member 15 are substantially horizontal, the backrest frame 12 and the front and rear leg frames 13, 14 are substantially upright, and the lower ends of the front and rear leg frames 13, 14 are spaced apart from one another in order to support the chair frame on the ground surface. When the chair frame is in a folded state, as shown in FIG. 6, the backrest frame 12, the seat frame 11, the armrest member 15 and the front and rear leg frames 13, 14 are substantially upright.

Figure 2:
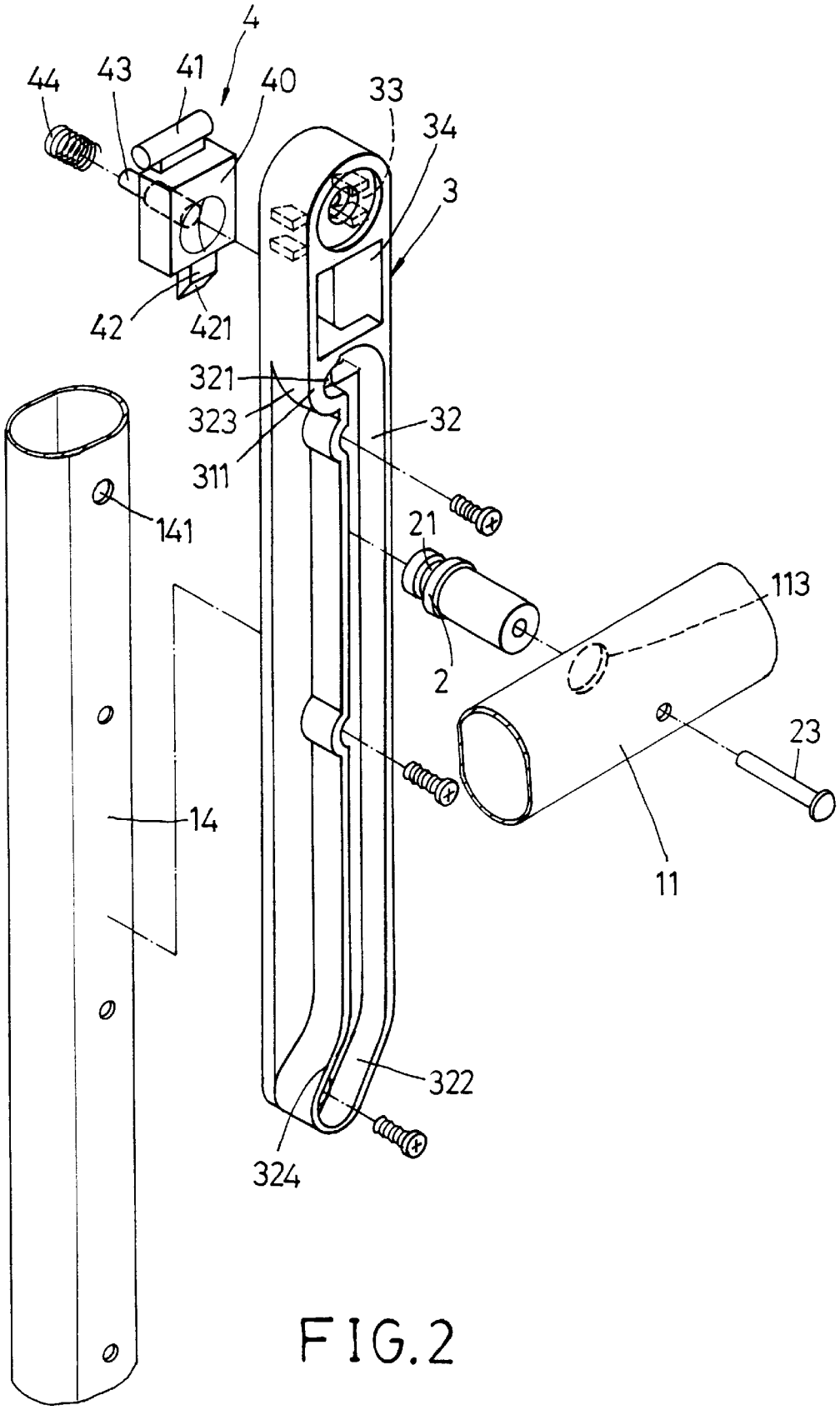
FIG. 2 is an exploded perspective view illustrating how a seat frame is coupled to a rear leg frame in the preferred embodiment.

Referring to FIGS. 1 and 2, a rail member 3 is fastened to one side of the rear leg frame 14 that faces the seat frame 11. The rail member 3 is formed with an elongated guiding groove 32 which opens toward the seat frame 11 and which extends along a longitudinal direction of the rear leg frame 14. The guiding groove 32 has a generally L-shaped upper portion with a lateral locking section 321 which extends away from a longitudinal axis of the guiding groove 32. The locking section 321 has an end wall 323 which is formed with a key projection 311 (best illustrated in FIG. 5) that extends into the locking section 321. The guiding groove 32 further has a lower portion with a downwardly inclined curved section 322 having an inclined abutment wall 324. The rail member 3 is further formed with an opening 34 above the guiding groove 32, and a pivot recess 33 above the opening 34.

A slide member 2 extends into a mounting hole 113 formed in one side of the seat frame 11 that faces the rear leg frame 14, and is fastened to the seat frame 11 by means of a rivet 23. The slide member 2 projects transversely from the seat frame 11 in a direction toward the rear leg frame 14 and is formed with an annular groove 21 therearound adjacent to a distal end thereof. The slide member 2 extends rotatably into the guiding groove 32 and is movable slidably therealong to couple pivotally the seat frame 11 and the rear leg frame 14. When the chair frame is in the unfolded state, as shown in FIG. 1, the slide member 2 is disposed in the upper portion of the guiding groove 32. When the chair frame is in the folded state, as shown in FIG. 6, the slide member 2 is disposed in the lower portion of the guiding groove 32.

A releasable locking unit 4 is mounted on the rail member 3 at the upper portion of the guiding groove 32. The locking unit 4 includes a press member 40 disposed above the guiding groove 32. The press member 40 has a lower part formed with a stop protrusion 42 that extends into the upper portion of the guiding groove 32 and that has a wedge-shaped end portion with an inclined face 421. The press member 40 further has an upper part formed with a horizontal pivot shaft 41 received rotatably in the pivot recess 33 of the rail member 3 for mounting pivotally to the rail member 3 such that the stop protrusion 42 is movable in a direction transverse to the longitudinal axis of the guiding groove 32 and toward and away from the rear leg frame 14. The press member 40 is exposed via the opening 34 in the rail member 3 to permit operation of the same by the user. The press member 40 has one side facing the rear leg frame 14 and formed with a support pin 43 which extends into a hole 141 in the rear leg frame 40. A biasing spring 44 is sleeved around the support pin 43 and is disposed between the rear leg frame 14 and the press member 40 for biasing the press member 40 away from the rear leg frame 14. When the press member 40 is in a non-depressed position, it is biased by the biasing spring 44 so that the stop protrusion 42 extends into the upper portion of the guiding groove 32.

Figure 3:
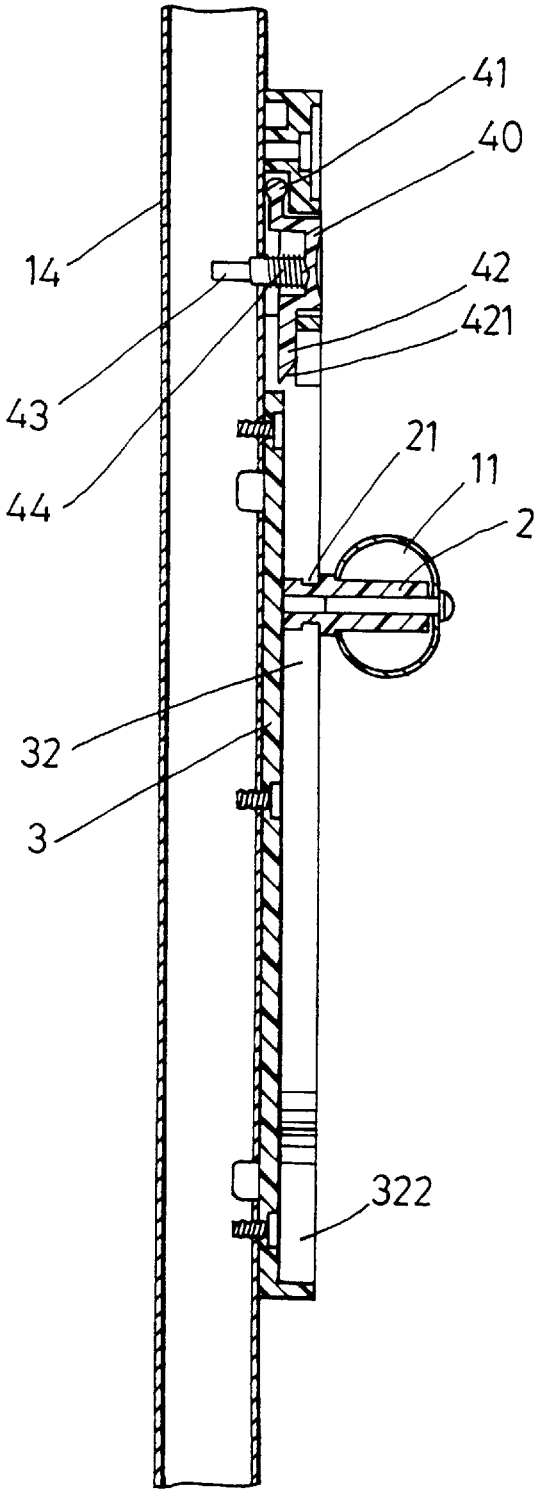
FIG. 3 and 4 are vertical sectional views illustrating relative movement between the seat frame and the rear leg frame during folding and unfolding of the preferred embodiment.
Figure 4:
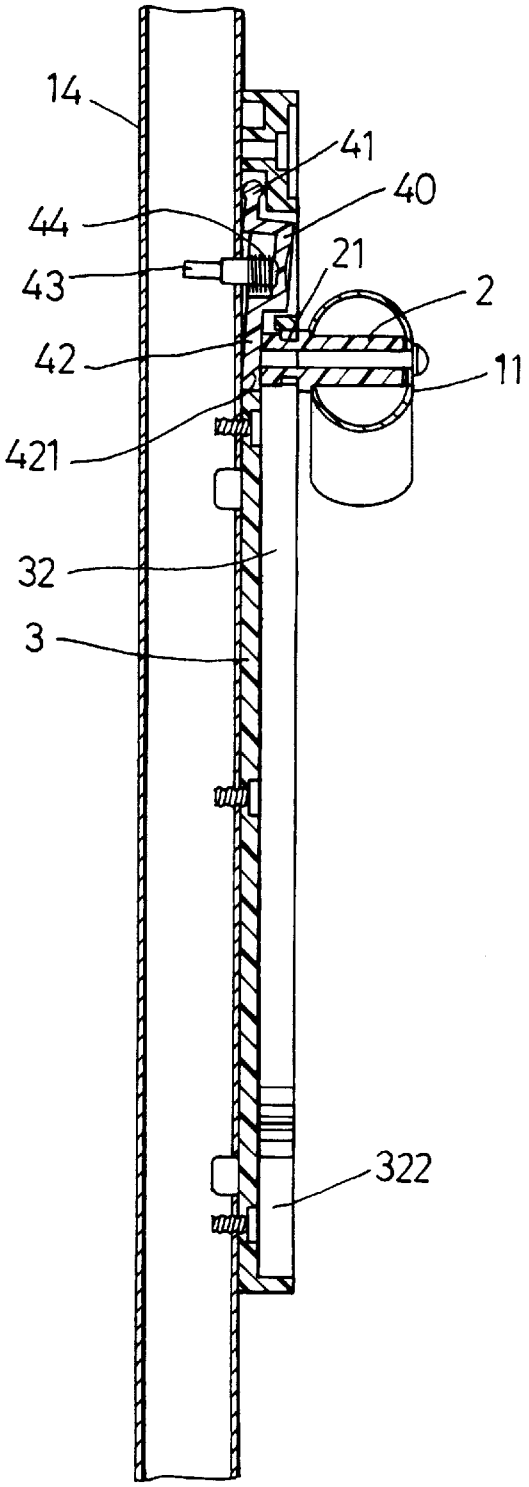
Figure 5:
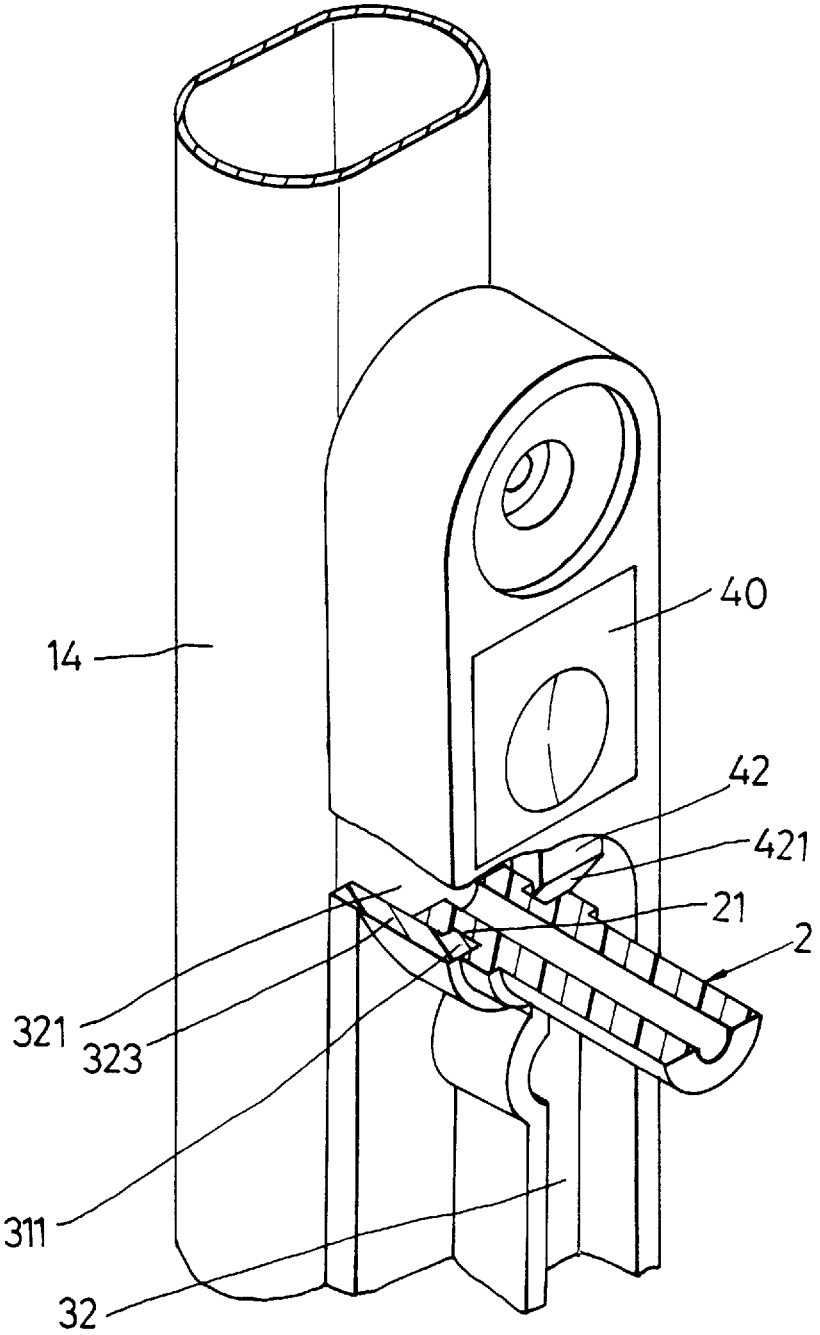
FIG. 5 is an enlarged, partly sectional fragmentary view illustrating the seat frame and the rear leg frame when the chair frame is in the unfolded state.

Referring to FIGS. 3 and 4, during unfolding of the chair frame, the slide member 2 slides upwardly along the guiding groove 32 to the upper portion of the latter. The slide member 2 is forced to slide past the inclined face 421 of the stop protrusion 42, thereby pushing the stop protrusion 42, as shown in FIG. 4, to result in pivoting movement of the stop protrusion 42 toward the rear leg frame 14 against the biasing force of the biasing spring 44. Thereafter, the slide member 2 is permitted to move into the locking section 321, as shown in FIG. 5. After the slide member 2 moves into the locking section 321, the stop protrusion 42 pivots away from the rear leg frame 14 due to expansion of the biasing spring 44 (see FIG. 3). Under this situation, the slide member 2 is clamped between the stop protrusion 42 and the end wall 323 of the locking section 321 to arrest undesired movement of the slide member 2 out of the locking section 321 so as to position the chair frame in the unfolded state. The key projection 311 formed on the end wall 323 of the locking section 321 engages the annular groove 21 of the slide member 2 to prevent movement of the slide member 2 toward and away from the rear leg frame 14 to help position the chair frame in the unfolded state.

Referring to FIGS. 2 and 5, to fold the chair frame, the press member 40 is pressed to compress the biasing spring 44 and to cause pivoting movement of the stop protrusion 42 about the pivot shaft 41 and toward the rear leg frame 14. The slide member 2 is thus permitted to move out of the locking section 321 for sliding downwardly along the guiding groove 32. Referring to FIGS. 2 and 6, when the slide member 2 moves into the curved section 322 at the lower portion of the guiding groove 32, the abutment wall 324 of the curved section 322 abuts against the slide member 2 to prevent untimely upward sliding movement of the slide member 2 along the guiding groove 32. Unforced unfolding of the chair frame can thus be prevented.

It has been shown that, the foldable chair frame of the present invention can be prevented from untimely folding in an effective manner when it is in an unfolded state. Moreover, in the illustrated embodiment, the chair frame can also be positioned releasably in the folded state to prevent unforced unfolding movement thereof.

With this invention thus explained, it is apparent that numerous modifications and variations can be made without departing from the scope and spirit of this invention. It is therefore intended that this invention be limited only as indicated in the appended claims.

I claim:

1. A foldable chair frame, comprising:

a backrest frame having a lower end;

a seat frame having a rear end pivoted to said lower end of said backrest frame;

an armrest member disposed adjacent to said backrest frame and having a rear end pivoted to said backrest frame;

a front leg frame disposed adjacent to said seat frame, said front leg frame having an upper end pivoted to said armrest member, a lower end adapted to be supported on a ground surface, and an intermediate section between said upper and lower ends and pivoted to said seat frame;

a rear leg frame disposed adjacent to said seat frame, said rear leg frame having an upper end pivoted to said armrest member, and a lower end adapted to be supported on a ground surface;

said chair frame being movable between an unfolded state, in which said seat frame and said armrest member are substantially horizontal, said backrest frame and said front and rear leg frames are substantially upright, and said lower ends of said front and rear leg frames are spaced apart from one another, and a folded state, in which said backrest frame, said seat frame, said armrest member and said front and rear leg frames are substantially upright;

a rail member mounted on one side of said rear leg frame facing said seat frame between said upper and lower ends of said rear leg frame, said rail member being formed with an elongated guiding groove which opens toward said seat frame and which extends along a longitudinal direction of said rear leg frame, said guiding groove having an upper portion with a lateral locking section that extends away from a longitudinal axis of said guiding groove, and a lower portion;

a slide member mounted on said seat frame and projecting transversely from said seat frame in a direction toward said rear leg frame, said slide member extending rotatably into said guiding groove and being movable slidably along said guiding groove to couple pivotally said seat frame and said rear leg frame, said slide member being disposed in said upper portion of said guiding groove when said chair frame is in the unfolded state, and being disposed in said lower portion of said guiding groove when said chair frame is in the folded state; and a releasable locking unit mounted on said rail member at said upper portion of said guiding groove, said locking unit permitting movement of said slide member into said locking section during unfolding of said chair frame, said locking unit arresting movement of said slide member out of said locking section so as to position said chair frame in the unfolded state, said locking unit being operable to release said slide member from said locking section to permit downward sliding movement of said slide member along said guiding groove during folding of said chair frame.

2. The foldable chair frame according to claim 1, wherein said locking unit includes a press member disposed above said guiding groove and having a lower part formed with a stop protrusion that extends into said upper portion of said guiding groove, and an upper part mounted pivotally to said rail member about a horizontal axis such that said stop protrusion is movable in a direction transverse to the longitudinal axis of said guiding groove and toward and away from said rear leg frame, said stop protrusion being wedge-shaped to enable said slide member to slide past said stop protrusion when said slide member is moved into said locking section, said locking unit further including a biasing spring for biasing said press member such that said stop protrusion is moved away from said rear leg frame to arrest undesired movement of said slide member out of said locking section, said press member being operable to move said stop protrusion toward said rear leg frame to permit movement of said slide member out of said locking section when folding said chair frame.

3. The foldable chair frame according to claim 2, wherein said locking section has an end wall, said slide member being clamped between said end wall and said stop protrusion to position said chair frame in the unfolded state.

4. The foldable chair frame according to claim 3, wherein said end wall has a key projection, said slide member having an annular groove which engages said key projection to prevent movement of said slide member toward and away from said rear leg frame when said slide member is clamped between said end wall and said stop protrusion.

5. The foldable chair frame according to claim 1, wherein said lower portion of said guiding groove has a downwardly inclining curved section with an abutment wall for abutting against said slide member when said slide member moves into said curved section to prevent untimely upward sliding movement of said slide member along said guiding groove, thereby preventing unforced unfolding movement of said chair frame.

* * * * *